United States Patent [19]

Gurries

[11] 4,230,369

[45] Oct. 28, 1980

[54] PAVEMENT PLANING METHOD AND APPARATUS

[75] Inventor: Raymond A. Gurries, Reno, Nev.

[73] Assignee: The Gurries Company, Sparks, Nev.

[21] Appl. No.: 973,163

[22] Filed: Dec. 26, 1978

Related U.S. Application Data

[63] Continuation-in-part of Ser. No. 873,249, Jan. 30, 1978, abandoned.

[51] Int. Cl.[2] ..... A01B 35/00; E01C 23/09

[52] U.S. Cl. ..... 299/14; 37/DIG. 18; 172/40; 299/37

[58] Field of Search ..... 404/90, 91; 299/14, 299/37; 37/DIG. 18; 15/93 R; 172/40; 173/49, 100; 175/56

[56] References Cited

U.S. PATENT DOCUMENTS

| | | | |
|---|---|---|---|
| 2,197,154 | 4/1940 | Miller | 299/37 |
| 2,586,917 | 2/1952 | Conforto | 299/37 |
| 3,232,669 | 2/1966 | Bodine | 299/37 |
| 3,269,039 | 8/1966 | Bodine | 175/56 X |
| 3,367,716 | 2/1968 | Bodine | 299/14 |
| 3,437,381 | 4/1969 | Bodine | 299/14 X |
| 3,527,501 | 9/1970 | Shatto | 173/49 X |
| 3,770,322 | 11/1973 | Cobb et al. | 299/14 X |
| 4,003,603 | 1/1977 | Stemler et al. | 173/100 X |

*Primary Examiner*—Ernest R. Purser

*Attorney, Agent, or Firm*—Townsend and Townsend

[57] ABSTRACT

Asphalt or concrete pavement is removed from a road bed by an elongated cutter blade that extends in a downward and forward direction along a cutting plane to a cutting edge. The cutting plane forms an acute angle of between 45° and 55° with the surface of the pavement. The cutter blade is intermittently driven with a force parallel to the cutting plane in the forward direction while the cutting edge penetrates the pavement to drive the cutter blade incrementally in a forward direction and plane off the pavement in a chisel-like manner. A source of vibrations is connected to one end of plural spaced apart resonant beams. At the other end, the beams drive the cutter blade.

30 Claims, 13 Drawing Figures

PAVEMENT PLANING METHOD AND APPARATUS

CROSS-REFERENCE TO RELATED APPLICATIONS

This application is a continuation-in-part of my application Ser. No. 873,249, filed Jan. 30, 1978 now abandoned, the disclosure of which is incorporated fully herein by reference.

BACKGROUND OF THE INVENTION

This invention relates to road working equipment and, more particularly, to a method and apparatus for removing pavement from a road bed.

When resurfacing a road, it is often desirable to remove the existing pavement in order to maintain the original grade and/or recycle the pavement material in the case of asphalt. There are a number of known procedures for removing asphalt pavement, all of which require an expenditure of a great deal of time, money, and/or effort.

One procedure is to soften the asphalt pavement with a radiant heater or flame burner, and then clean off the softened asphalt in layers with the mold board of a road grader. The thickness of each layer removed in this manner is limited by the depth of the asphalt that can be softened by the radiant heater or flame burner, which is very small.

Another procedure that has been used without much success is to remove the asphalt pavement with a plurality of diamond cutting wheels arranged on a common rotating shaft. The experience has been that these cutting wheels are expensive and the operation is slow.

A third procedure is to mill off the pavement in layers with a rotating drum on which carbide tips or teeth are mounted. In order to make a deep cut in the pavement, a great deal of downward force needs to be exerted on the drum, which results in too many fine particles if the asphalt is to be recycled.

Still another procedure is to use sonic energy to cut into pavement. As described in Bodine U.S. Pat. No. 3,232,669, a sonic vibration generator is coupled to the upper end of an essentially vertical beam or bar having pavement-engaging teeth or serrations formed at its lower end. The vibration generator supplies energy to the beam at its resonant frequency, and the vibrating teeth at the lower end of the beam cut into the pavement.

SUMMARY OF THE INVENTION

One aspect of the invention is a method for removing asphalt or concrete pavement from a road bed. A transversely elongated cutter blade that extends in a downward and forward direction along a cutting plane to a transverse cutting edge is held in contact with the pavement such that the cutting plane forms an acute angle with the surface of the pavement of between 45° and 55°. The cutter blade engages the pavement such that the cutting edge penetrates the pavement. The cutter blade is intermittently driven at sonic frequency with a force parallel to the cutting plane in the forward direction while the cutting edge penetrates the pavement to drive the cutter blade incrementally in a forward direction and plane off the pavement in a chisel-like manner.

Another aspect of the invention is pavement planing apparatus comprising a transversely elongated cutter blade mounted on a support frame to permit reciprocation approximately in a cutting plane. The cutter blade is disposed at an acute angle between 45° and 55° to the surface of a pavement, and extends in a downward and forward direction along the cutting plane to a cutting edge that lies in the cutting plane. Plural spaced apart force transmitting beams having an input and an output are mounted on the support frame, a source of vibrations at sonic frequency is connected to the input of the force transmitting beams, and the output thereof strikes the cutter blade to apply a unidirectional force thereto parallel to the cutting plane in a forward direction. A vehicle continuously transports the support frame in the forward direction while the unidirectional force is being applied to the cutter blade. The cutter blade with the described apparatus engages and planes off pavement in a chisel-like manner as the apparatus is transported in the forward direction.

A feature of the foregoing apparatus is a support frame comprising plural spaced apart upright support beams, plural spaced apart forwardly projecting support beams, and plural struts, all equal in number to the force transmitting beams. The top of the upright support beams is attached to the back of the respective forwardly projecting support beams. One end of the struts is attached to the front of the respective forwardly projecting support beams and the other end of the struts is attached to the bottom of the respective upright support beams. The force transmitting beams are mounted on the support frame so they are approximately parallel to the respective struts, with the input near the front of the respective forwardly projecting support beams and the output near the bottom of the respective upright support beams. The cutter blade lies in front of the output of the force transmitting beam approximately under the upright support beams. Preferably, the upright support beams have a larger mass per unit length than the forwardly projecting support beams and the struts. As a result, the center of gravity of the support frame is located nearly directly over the cutter blade so its weight counteracts most effectively the reactive forces exerted on the cutter blade by the material being cut.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figure 1:
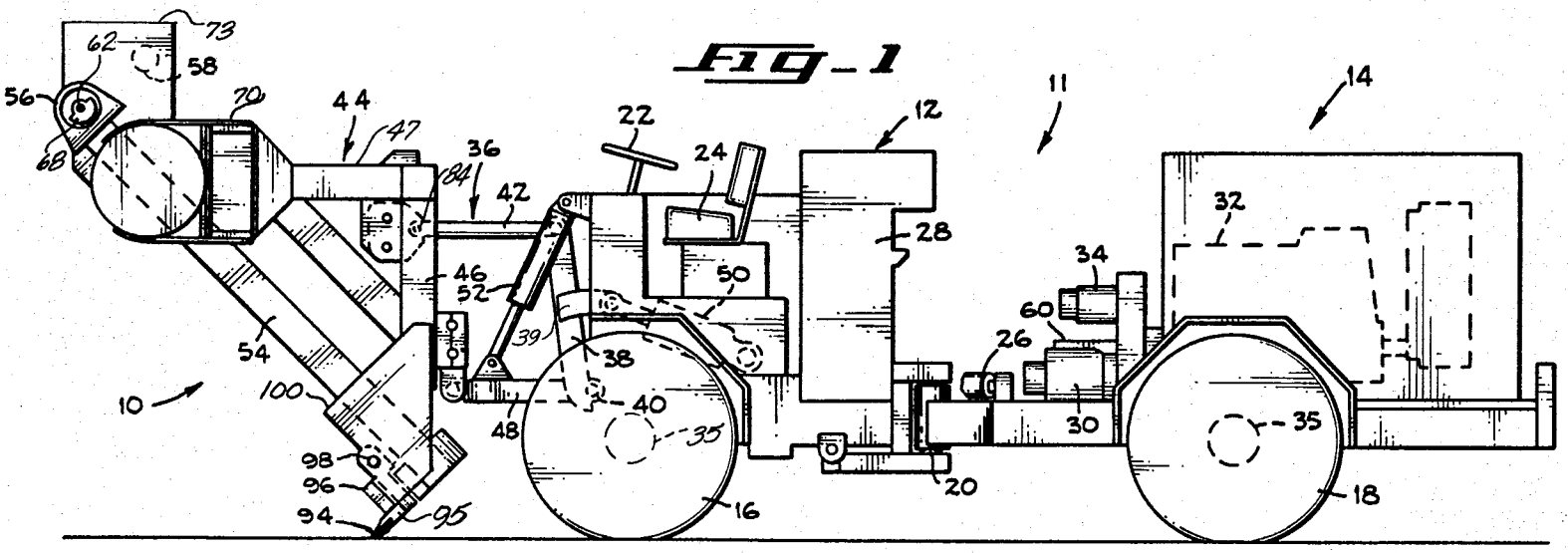
FIG. 1 is a side elevational view of tool driving apparatus embodying the present invention and especially arranged to cut or shear hard material such as asphalt or concrete.

It is the general objective of the present invention to provide apparatus for effectively applying driving force to a tool, such as a cutter blade, for rapidly shearing or cutting hard material such as a layer of concrete, asphalt, or other material from a roadway or similar surface, or to various other tools specific to a particular operation.

Specifically, the tool can take the form of a cutter blade having an elongated cutting edge arranged to engage concrete or other material to be removed at a controlled angle and at a controlled depth, and having a transverse disposition so that, upon energization, a swath of predetermined width can be simultaneously removed. The cutter blade is mounted from a powered and steered mobile frame for reciprocating motion, which mounting preferably constitutes a pivotal support for the cutter blade so that it moves arcuately first in a forward cutting direction and then rearwardly. The point of pivotal support is in advance of the cutting edge in the direction of cutting so that such pivotal motion is directed angularly downward into the material which is to be cut or severed, and at an angle which will vary dependent on the hardness and other mechanical properties of the material, and which can be adjusted to optimize the operation.

Force impulses are delivered cyclically to the pivotally supported cutter blade by reciprocating drive means, which on its forward stroke engages and drives the cutter blade into the material and thence withdraws preparatory to a subsequent driving stroke, forming a gap between the cutter blade and the drive means. Forward motion of a mobile supporting frame generates a tractive force which tends to close the gap in a fashion such that the reciprocating drive means is brought into contact with the cutter blade after the former's speed (and momentum) approaches a maximum in the forward or cutting direction. Thus, the drive means is in driving contact with the cutter blade itself for less than 180° of any given cycle.

The drive means takes the form of a resonant force transmitting member powered by a sonic generator or oscillator incorporating the general principles embodied in the unit shown and described in the aforementioned patent. However, the resonant member constitutes a generally upright beam mounted by a resilient tire at its upper node position to accommodate "pseudo-nodes" generated during operation. An additional rigid member engages the beam at its lower node position to support and maintain the desired beam disposition. The sonic generator is connected to the resonant beam at its upper end and preferably includes multiple eccentric weights mounted in spaced relation with a multiplicity of bearings on a common shaft so that the requisite force may be generated while minimizing the shaft diameter, and the peripheral speed and wear of the bearings because of the distribution of the bearing loads. The lower end of the beam lies adjacent the cutter blade to deliver the force impulses in substantial alignment with the cutting direction.

The input force generated by the sonic generator is greater than the described tractive force resultant from the forward motion of the powered mobile supporting frame, and as a consequence, there is no possibility for clamping of the beam end against the cutter blade (and the engaged material), which would stop the resonant actuation and permit the vibratory action of the sonic generator to be applied in a harmful fashion to itself and the supporting frame members.

Obviously, the same force imbalance principle can be applied to other tools such as mentioned, with the same critical and advantageous effect. In each case, however, it is important that the sonic generator provide an input force greater than that of a continuing tractive effect or its equivalent force tending to close the gap.

Figure 2:
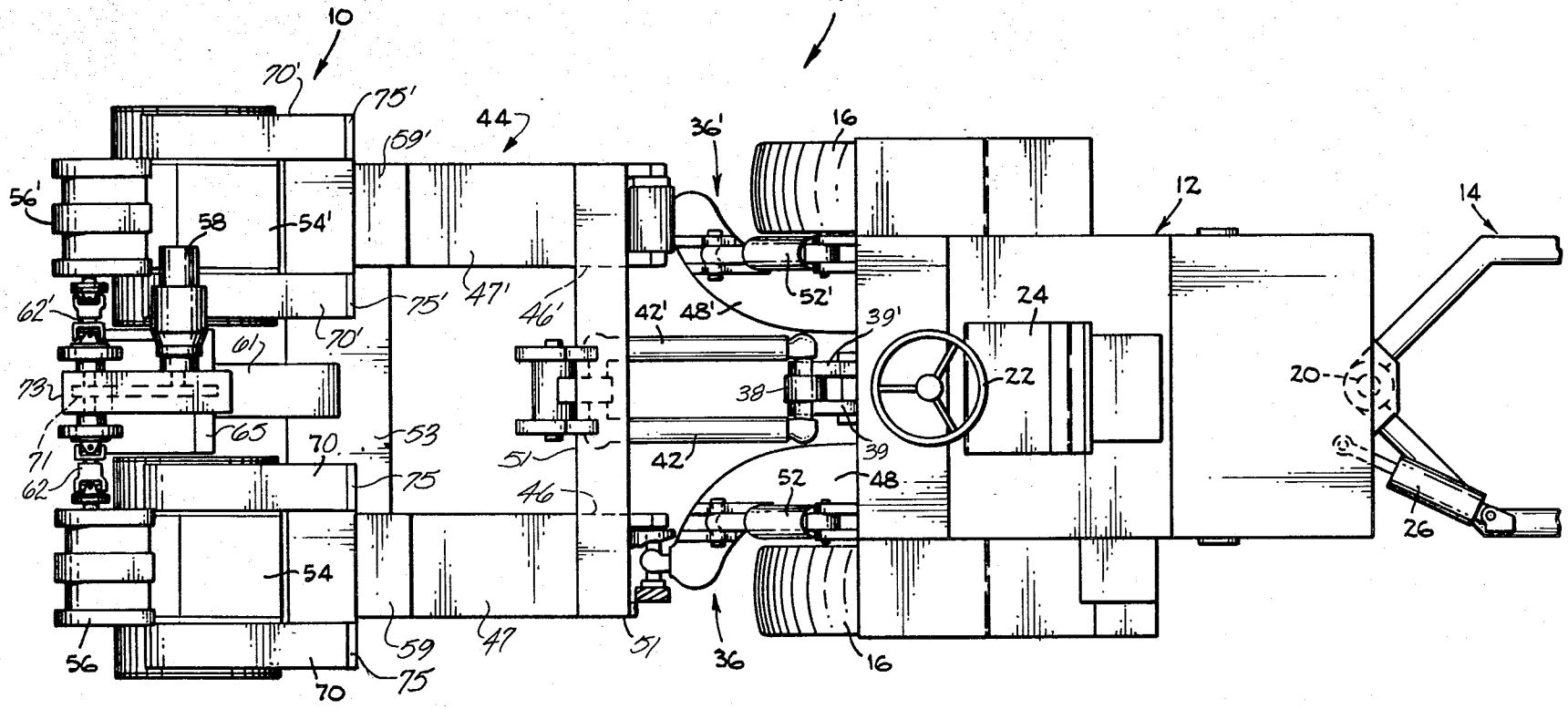
FIG. 2 is a top plan view of the front of the apparatus of FIG. 1.

With initial reference to FIGS. 1 and 2, a material cutting assembly generally indicated at 10 is mounted at the front of a mobile carrier 11 which includes forward and rearward frame sections 12, 14, each supported by two rubber-tired wheels 16, 18, the two frame sections being connected by a vertical pivot pin 20 which enables articulation of the frame sections for purposes of steering. Material cutting assembly 10 is specifically designed to cut asphalt or concrete pavement as found on streets, roads, and highways.

A steering wheel 22 is mounted forwardly of a driver's seat 24 on the front section 12 of the frame and is arranged to energize, upon turning, a hydraulic ram 26 pivotally joining the frame sections 12, 14 so as to effect articulation thereof and consequent steering. A hydraulic pump 30 is mounted on the rear section 14 of the frame, and driven by an internal combustion engine 32. Fluid from a hydraulic reservoir 28 is driven by pump 30 through suitable hydraulic conduits (not shown) to hydraulic ram 26.

The engine 32 also drives a second hydraulic pump 34 which is hydraulically connected to hydraulic motors 35 to drive the wheels 16 on the front frame section 12 and the wheels 18 on the rear frame section 14, thus to provide motive power for the entire mobile carrier 11 in a generally conventional fashion. As will be understood, the motive power delivered to the wheels will urge the frontmounted cutting assembly 10 against material being cut with a certain tractive force which, for cutting a six-foot swath of concrete or asphalt, should vary for example between 5,000 and 60,000 pounds, depending upon the material resistance and vehicle speed. Assuming the weight of the vehicle and its load, i.e., material cutting assembly 10 and mobile carrier 11, is 75,000 pounds, the maximum tractive force, i.e., motive power delivered to the wheels, must be less than the weight of the vehicle and its load, e.g., about 60,000 pounds, to prevent slippage of wheels 16 and 18. As is well known in the art, the maximum tractive force of the vehicle depends upon the friction between the wheels and the surface on which it moves.

Material cutting assembly 10 is symmetrical about a center plane in the direction of movement, i.e., parallel to the plane of FIG. 1. Many of the elements on the right side of the center plane, as viewed from the front, i.e., the left in FIG. 1, which are identified by unprimed reference numerals, have counterparts on the left side of the center plane, which are identified by the same reference numerals primed.

Figure 9:
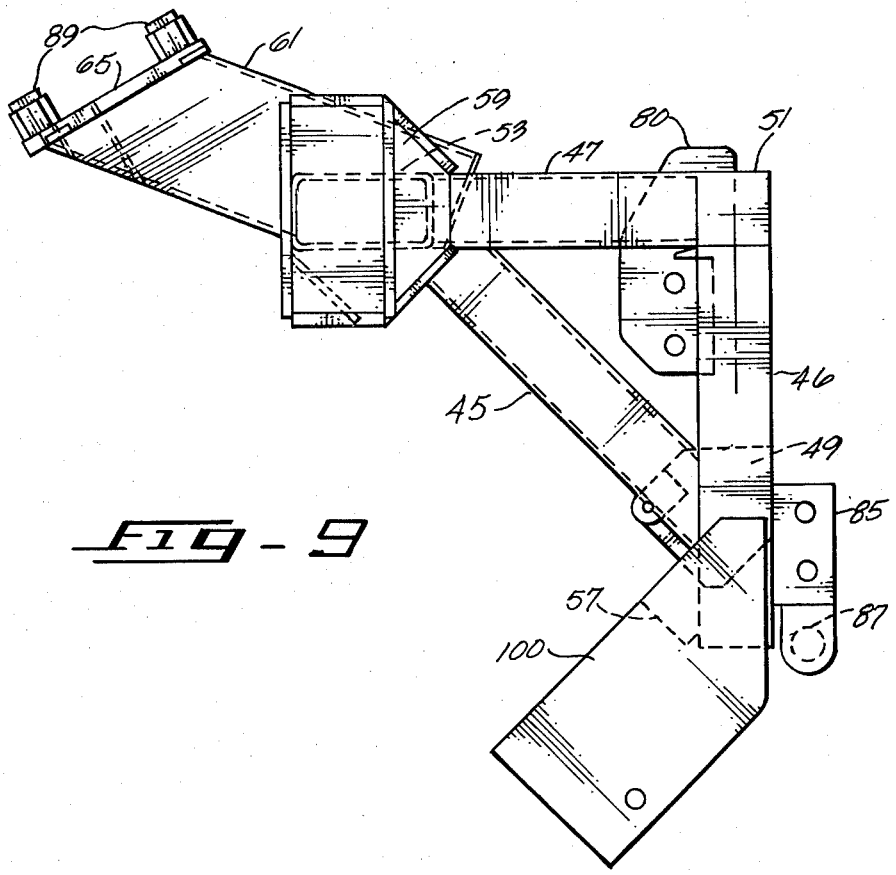
FIG. 9 is a side elevation view of the cutting assembly support frame of the apparatus of FIG. 1.
Figure 10:
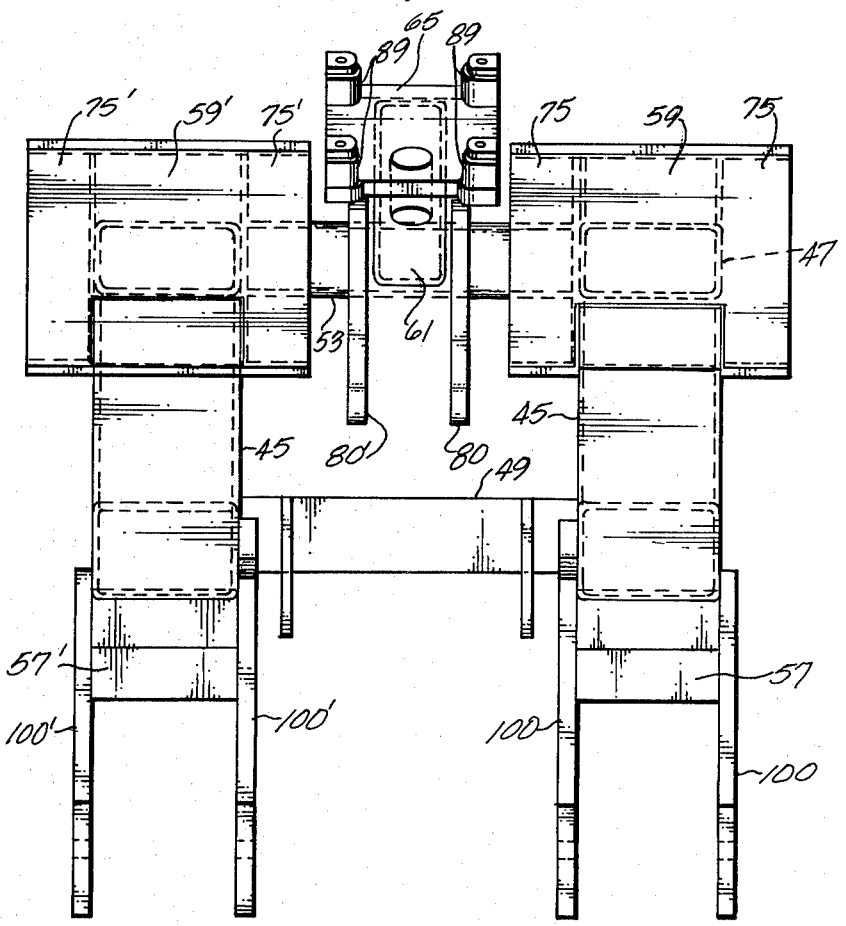
FIG. 10 is a front elevation view of the support frame of FIG. 9.
Figure 11:
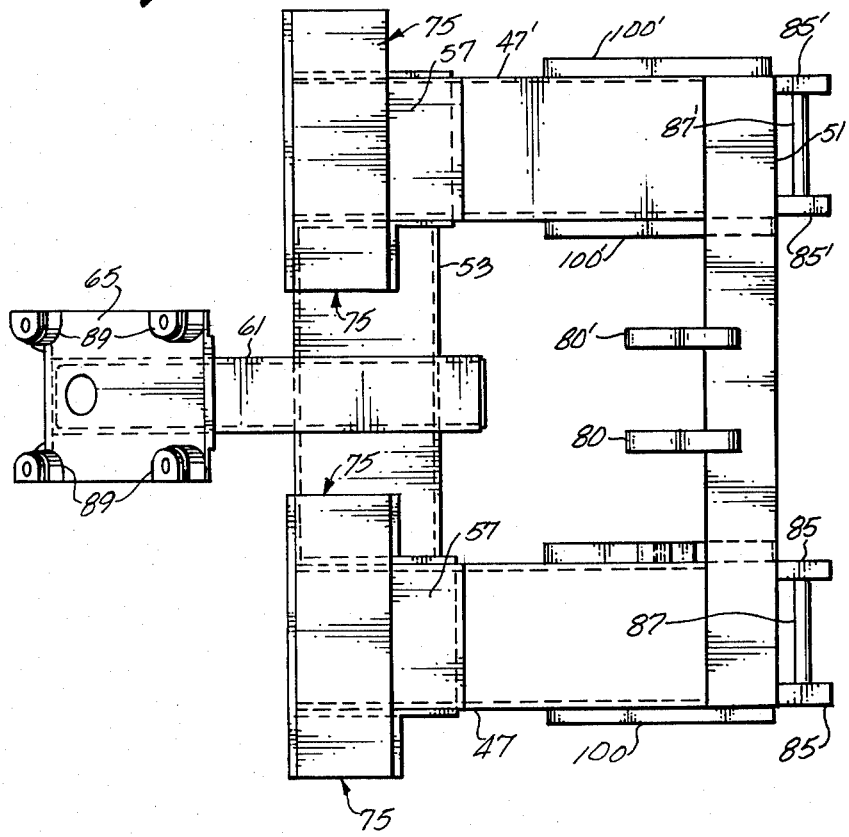
FIG. 11 is a top plan view of the support frame of FIG. 9.

In order to mount the mentioned material cutting assembly 10, a pair of laterally-spaced parallelogram units 36, 36' extend forwardly from the forward frame section 12. More particularly, the parallelogram units 36, 36' include an upstanding leg 38 pivotally connected at its lower extremity to the central portion of a fixed transverse shaft 40 on the front frame section 12 and pivotally joined at its upper extremity to the rear ends of forwardly projecting legs 42, 42'. These forwardly projecting legs 42, 42' are pivotally joined at laterally-spaced positions (see FIG. 2) to a generally triangular cutting assembly support frame 44. As shown in FIGS. 9 through 11, cutting assembly frame 44 comprises spaced apart, upright support beams 46, 46', spaced apart, forwardly projecting support beams 47, 47', struts 45, 45', and cross beams 49, 51, and 53. Downwardly and forwardly angled stop mounts 57, 57', are formed near the bottom of upright support beams 46, 46'. At its ends, cross beam 51 is attached, for example by welding, to the top of support beams 46, 46', and the back of support beams 47, 47'. At the front of support beams 47, 47' are formed vertically flared bracket mounts 59, 59'. Cross beam 53 is connected between flared bracket mounts 59, 59' and is attached thereto, for example, by welding. An upwardly and forwardly extending platform support beam 61 is attached, for example by welding, to the middle of the cross beam 53. A platform 65 having mounting blocks 89 is attached to the upper end of support beam 61, for example, by welding. Struts 45, 45' are connected between beams 47, 47' near the front, and beams 46, 46' near the bottom and are attached thereto, for example, by welding. Cross beam 49 is connected between support beams 46, 46' near the bottom and is attached thereto, for example, by welding. Pairs of rectangular brackets 75, 75' are attached, for example, by welding to the sides of flared bracket mounts 59, 59'. Support beams 46, 46' and cross beams 49 and 51 are made of solid steel so their mass per unit length is as large as possible. Support beams 47, 47', including bracket mounts 59, 59', struts 45, 45', and cross beam 53 are hollow so their mass per unit length is as small as possible. Consequently, the resultant center of gravity of cutting assembly frame 44 is rearwardly located near support beams 46, 46'. Support beams 46, 46' form the forward upright legs of the parallelogram units 36, 36'. Lower and outwardly curving legs 48, 48' are pivotally connected at their opposite extremities to the lower ends of the support beams 46, 46' and the previously described shaft 40, thus completing the two parallelogram units 36, 36'. Brackets 80, 80' are attached to crossbeam 51, for example, by welding. Forwardly projecting legs 42, 42' are connected to brackets 80, 80' by pivoting links 84, 84' (FIG. 1). Pairs of brackets 85, 85' are attached to upright support beams 46, 46', for example, by welding. Outwardly-curving legs 48, 48' are connected to bracket pairs 85, 85' by pivot pins 87, 87'.

A powered hydraulic ram 50 is pivotally secured by a bracket 39, 39' between the forward frame section 12 and the rear upright leg 38 of the parallelogram units 36, 36' to enable powered variation of the parallelogram disposition and accordingly the angular disposition of the cutting assembly 10. Additional powered hydraulic rams 52, 52' pivotally joined to the top of the frame section 12 and the lower generally horizontal legs 48, 48' of the parallelogram units 36, 36' enable substantially vertical adjustment of the cutting assembly.

Figure 3:
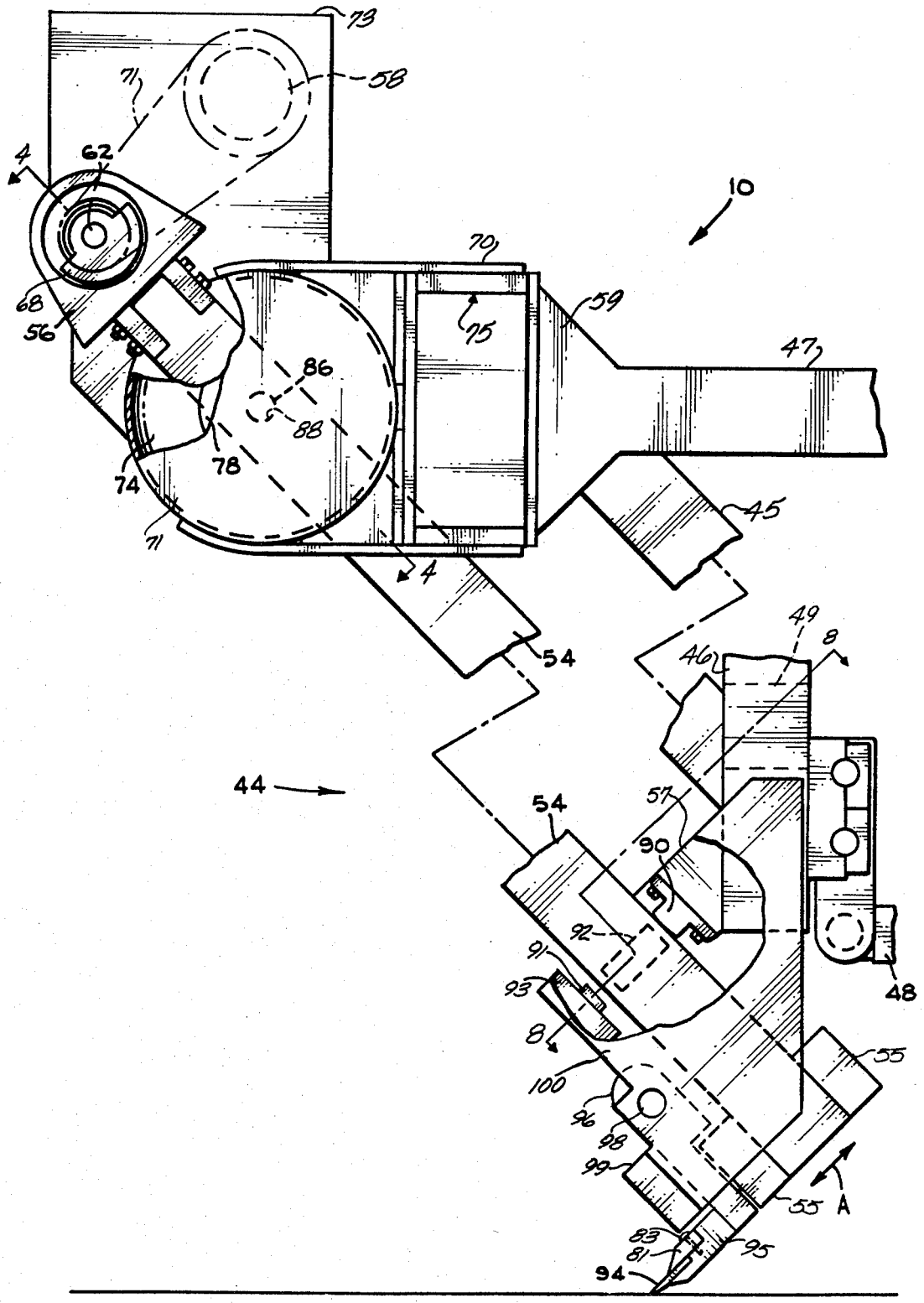
FIG. 3 is a fragmentary enlarged side view of the material cutting assembly of the apparatus with portions broken away to show interior details.
Figure 4:
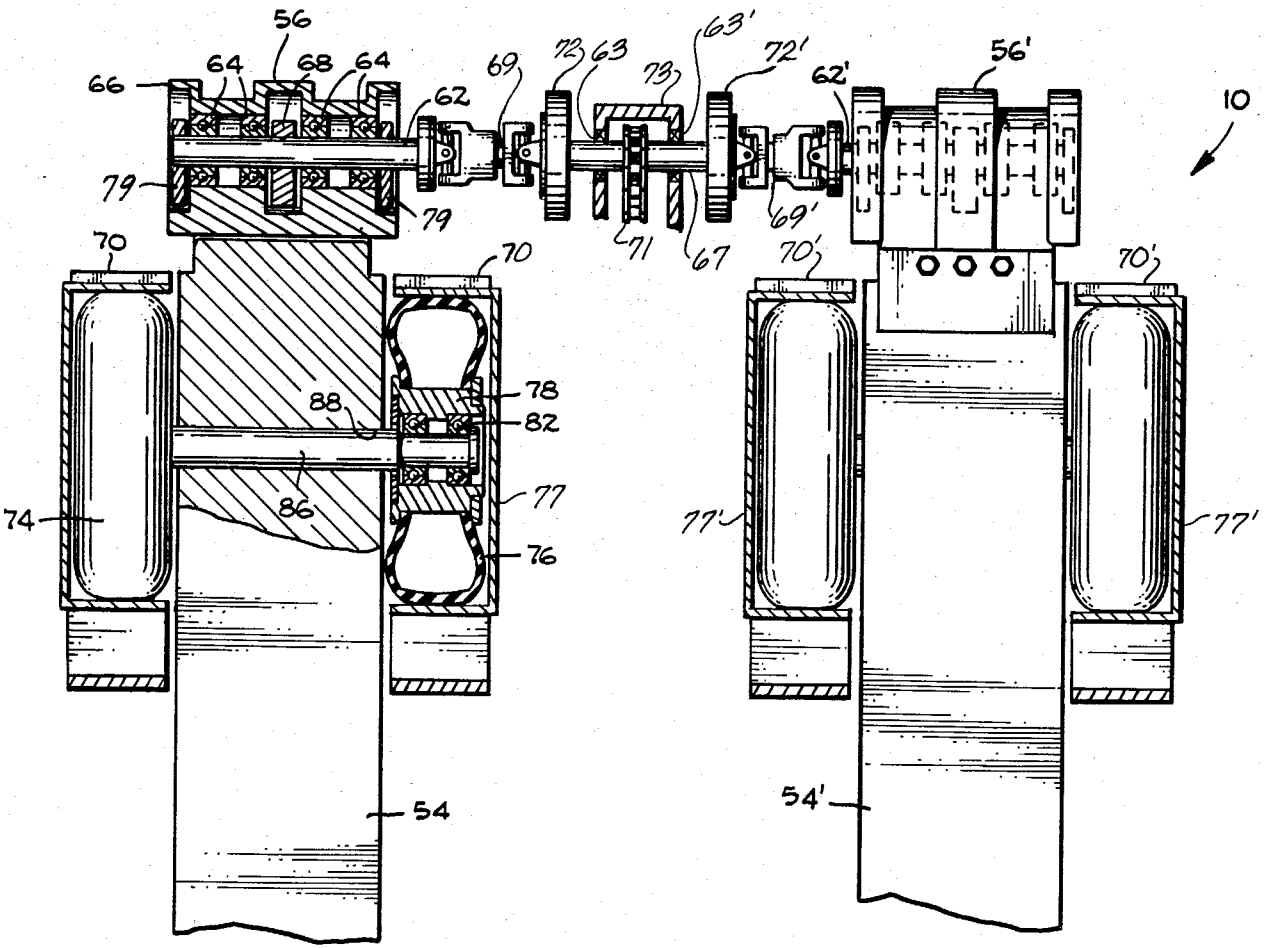
FIG. 4 is a fragmentary cross-sectional view taken along line 4—4 of FIG. 3.

The cutting assembly frame 44 supports a pair of resonant beams 54, 54' in the form of angularly upright parallel resonant beams composed of solid steel or other elastic material. Resonant beams 54, 54' are approximately parallel to struts 45, 45'. A sonic generator in the form of a pair of synchronized orbiting mass oscillators 56, 56' is secured by bolts or the like to the upper extremity of each resonant beam and generally incorporates the principles of an orbiting mass oscillator of the type shown in either U.S. Pat. No. 2,960,314 or U.S. Pat. No. 3,217,551. (The disclosures of these patents are incorporated fully herein by reference). Orbiting mass oscillators 56, 56' are driven by a suitable hydraulic motor 58, that is energized through suitable hydraulic conduits (not shown) from a third hydraulic pump 60 driven by the previously described engine 32. In order to maximize the resonant power yet provide an extensive useful life, each orbiting mass oscillator 56, 56', as best shown in FIGS. 3 and 4, includes a shaft 62 driven by the hydraulic motor 58 and supported at several axially spaced positions by bearings 64 in a generator housing 66. A plurality of eccentric weights 68 and 79 are carried by the shaft 62 adjacent to the bearings 64 so that their load on the shaft and the bearing loads are distributed. Preferably, the eccentric mass of the centrally located weight 68 is twice as large as peripherally located weights 79; thus, the load on each of bearings 64 is approximately the same. The shaft can be relatively small because of such load distribution, and the exterior diameter and thus peripheral speed of the bearings can be minimized for a given power level. Rather than bolting the sonic generator to the beams as shown, the sonic generator housing and the beams could be cast as a single unit in a one-piece construction.

A drive shaft 67 is coupled by pairs of tandemly connected universal joints 69, 69' to shafts 62, 62'. Drive shaft 67 is supported by bearings 63, 63' mounted in the sidewalls of a protective housing 73, through which drive shaft 67 passes. Power transmission means 71 such as a belt, chain, or gear train inside housing 73 couples hydraulic motor 58 to drive shaft 67. Lubricating oil is sprayed in housing 73 by means (not shown) onto power transmission means 71 and bearings 63, 63'. Seals (not shown) outside of bearings 63, 63' prevent the oil spray from leaving housing 73. Protective housing 73 is secured to mounting blocks 89 (FIGS. 9 through 11). Motor 58 is attached, for example by bolting, to the outside of housing 73. Fly wheels 72, 72' are mounted on shaft 67 outside housing 73 for the purpose of isolating motor 58 and power transmission means 71 from transient forces exerted by oscillators 56, 56'. Housing 73 is stationary so drive shaft 67 only rotates. Resonant beams 54, 54' reciprocate. Tandemly connected pairs of universal joints 69, 69' permit shafts 62, 62' to reciprocate with beams 54, 54' as they are rotatably driven by drive shaft 67.

Energization of the exemplary embodiment illustrated provides a total peak energizing input force to the two resonant beams 54, 54' of 125,000 pounds in the form of sequential sonic oscillations at a sonic frequency of approximately 100 cycles per second, i.e., at or near the resonant frequency of resonant beams 54, 54'. Thus, the total peak force provided by oscillators 56, 56' is larger than the weight of the vehicle and its load. These force oscillations, delivered to the upper end of the beam, cause resonant vibration thereof through appropriate dimensional design of such beam at that frequency so that a corresponding cyclical reciprocal vibration at the lower end of the beam is derived, as shown by the arrow A in FIG. 3, preferably with a total peak-to-peak displacement of approximately one inch. Pairs of weights 55, 55' are attached, for example by bolting, to the front and back of resonant beams 54, 54' at the lower end to increase the momentum thereof. Each resonant beam 54, 54' is designed and so driven that two vibration nodes are formed thereon inwardly from its opposite extremities, and its ends are free to vibrate, i.e., reciprocate, and in fact do vibrate. In summary, resonant beams 54, 54' are driven to form standing wave vibrations in their fundamental free-form mode. Each beam is carried from the cutting assembly frame 44 at its upper node position. However, the connection is resilient to allow for node variations (pseudo-nodes) during actual operation. Specifically, as illustrated in FIGS. 3 and 4, pairs of rectangular brackets 75, 75' are attached, for example by welding, to the sides of flared bracket mounts 59, 59'. Pairs of annular resilient members 74, 74' in the form of pneumatic rubber tires are located inside pairs of cylindrical housings 77, 77'. Housing pairs 77, 77' are held on opposite sides of resonant beams 54, 54' by pairs of connecting arms 70, 70' attached, for example by bolting, to bracket pairs 75, 75'. Pairs of annular resilient members 74, 74' are mounted on pairs of central hubs 78, 78'. Shafts 86, 86' are press fitted into bores 88, 88' in resonant beams 54, 54' at their upper node positions. Hub pairs 78, 78' are mounted for rotation on the ends of shafts 86, 86' by pairs of bearings 82, 82'. Thus, resonant beams 54, 54' are supported by shafts 86, 86' and are pivotable about their axes by virtue of bearing pairs 82, 82'. In the manner of a spring, the described pneumatic tires, which serve as upper node supports for resonant beams 54, 54', accommodate the longitudinal changes in the node position (pseudo-nodes) resulting from loading of the resonant beams, when the cutter blade described below is in engagement with a material to be cut, sheared, or planed, and the internal tire pressure can be changed as required to control the spring constant.

Figure 8:
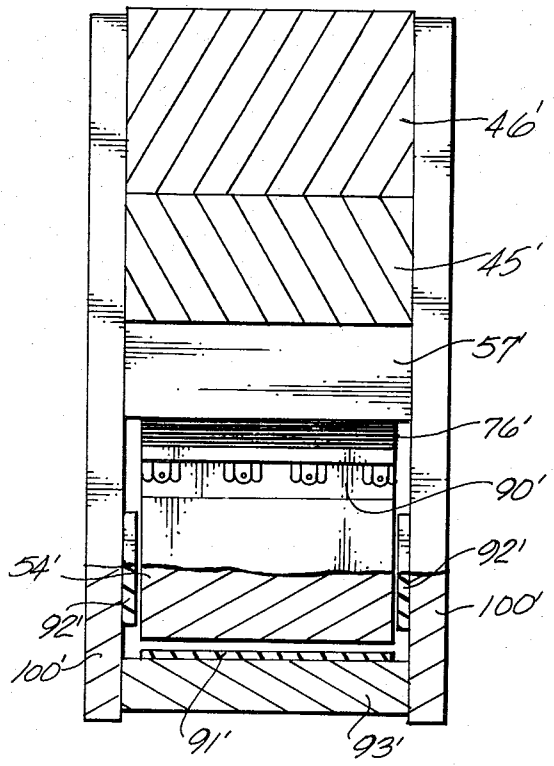
FIG. 8 is a fragmentary cross-sectional view taken along line 8—8 of FIG. 3, omitting the structure between the resonant beams.
Figure 8:
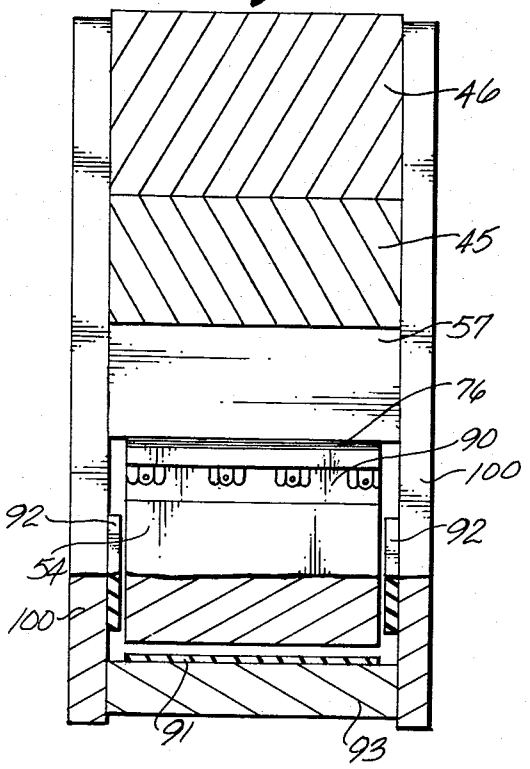

As shown in FIGS. 3 and 8, at the lower node position, resonant beams 54, 54' are encompassed by rigid metal stop members 90, 90' at their rear, resilient rubber pads 91, 91' at their front, and pairs of resilient rubber pads 92, 92' at their sides. Pad pairs 92, 92' and pads 91, 91' comprise pieces of rubber vulcanized on metal mounting plates. Members 90, 90', pads 91, 91', and pad pairs 92, 92' are secured to the lower end of cutting assembly frame 44. Specifically, stop members 90, 90' are attached for example by bolting, to mounts 57, 57'. Pairs of brackets 100, 100' are attached to opposite sides of support beams 46, 46', for example by bolting. Cross supports 93, 93' are connected between bracket pairs 100, 100', for example by bolting. Mounts 57, 57', bracket pairs 100, 100', and cross supports 93, 93' define rectangular openings through which the lower portions of resonant beams 54, 54' pass. Pads 91, 91' are secure to cross supports 93, 93', for example by bolting, and pad pairs 92, 92' are secured to the inside of bracket pairs 100, 100', for example by bolting. Pad pairs 92, 92' at the sides of resonant beams 54, 54' are spaced slightly therefrom and serve to guide the resonant beams as they pivot about their upper node support and reduce noise and wear. When resonant beams 54, 54' are at rest, they lie on and are supported by pads 91, 91'. When resonant beams 54, 54' are resonating during operation of the apparatus, their lower node is driven up against stop members 90, 90' by the reaction of the material being worked upon as shown in FIGS. 3 and 8, and remain in abutment with stop members 90, 90' during operation of the apparatus. Thus, stop members 90, 90' serve as rigid lower node supports for resonant beams 54, 54'. Stop members 90, 90' and pads 91, 91' are spaced sufficiently far apart to enable resonant beams 54, 54' to be shimmed to synchronize their transfer of force to the work tool. Specifically, shims 76, 76' are inserted between stop members 90, 90' and stop mounts 57, 57' so the lower extremities of resonant beams 54, 54' in their neutral position are both spaced precisely the same distance from the lever arms and cutter blade described below. Consequently, since oscillators 56, 56' run in phase and resonant beams 54, 54' reciprocate in phase, the lower extremities of resonant beams 54, 54' strike the cutter blade at the same time, i.e., in synchronism. As represented in FIG. 8 by the different thicknesses of shims 76, 76', stop members 90, 90' will in general have to be shimmed to a different degree to achieve the described synchronism, because of manufacturing tolerances. This is accomplished by the following procedure: first, one of the stop members is shimmed; second, the cutter blade is lowered into contact with the road surface; third, mobile carrier 11 is driven forward to rotate resonant beams 54, 54' about their upper node supports, until one of the resonant beams contacts its stop member at the lower node support; and fourth, the other stop member is shimmed until the other resonant beam contacts it. For more details about shimming stop members 90, 90' to synchronize resonant beams 54, 54', reference is made to my copending application Ser. No. 916,112, filed June 16, 1978.

Figure 7:
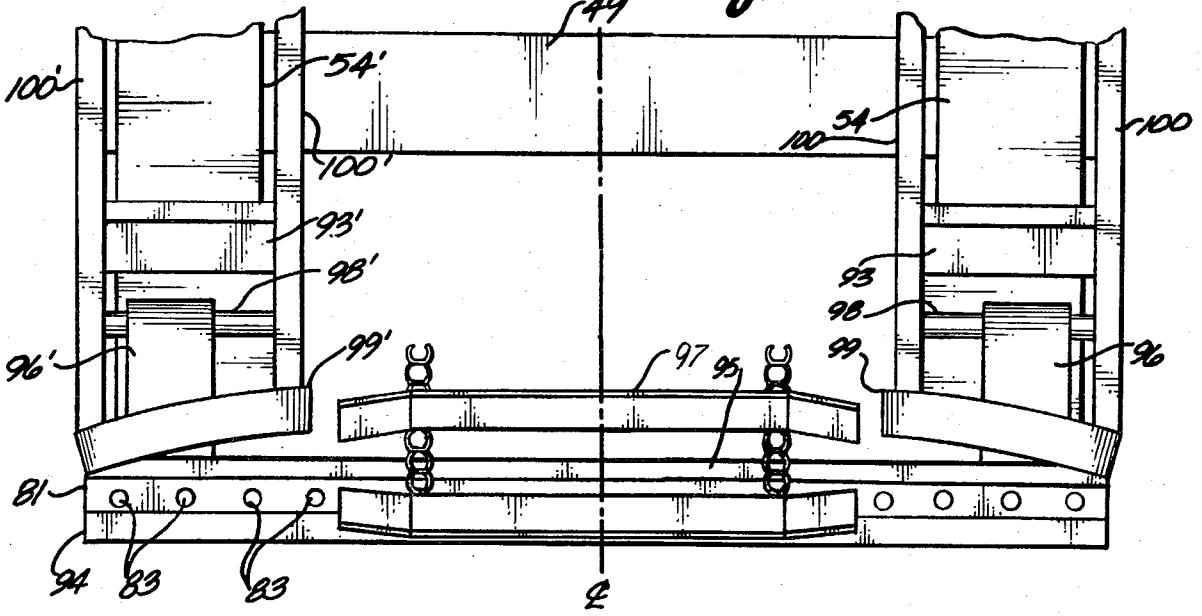
FIG. 7 is a front elevation view of part of the apparatus of FIG. 1.

As shown in FIGS. 3 and 7 the material cutting assembly 10 includes a work tool which takes the form of an angularly-directed and transversely-extending cutter blade 94 held in a blade base 95. Cutter blade 94 and blade base 95 extend along the full width of the apparatus between beams 54, 54'. In other words, cutter blade 94 is transversely elongated, in the sense that it is longer parallel to the width of the machine than perpendicular thereto, and is disposed at an acute angle to the surface of pavement to be cut, extending in a downward and forward direction along a cutting plane to a cutting edge that lies in the cutting plane. Cutter blade 94 is clamped to blade base 95 by a retaining bar 81 that is attached to blade base 95 by bolts 83. Lever arms 96, 96', are pivoted about substantially horizontal pivot pins 98, 98' on bracket pairs 100, 100'. Lever arms 96, 96' are attached, for example by welding to the ends of blade base 95 near resonant beams 54, 54'. It is to be particularly observed, as clearly shown in FIG. 3, that the cutting edge of the cutter blade 94, when in material engagement, lies to the rear of the pivot pins 98, 98' so that any movement of the cutter blade 94 in a forward direction or to the left will be accompanied by a substantial downward force component and thus will result in penetration into the material being cut, without deflection of cutter blade 94 away from material engagement. Furthermore, because the pivotal support provides for a slight arcuate motion of the cutter blade 94, a slight additional separation of the layer of cut material from that lying therebelow will result. Thus, the cutter blade assembly comprising cutter blade 94, blade base 95, retaining bar 81, and lever arms 96, 96' is pivotably supported by brackets 100, 100' so it is adjacent to the lower extremity of the resonant beams 54, 54'. When the beams reciprocate, they drive the cutter blade assembly in a forward and downward direction or to the left, as shown in FIG. 3, and thereafter withdraw from contact with the cutter blade assembly in its cyclical displacement in the opposite or rearward direction. Thus, only unidirectional driving impulses are delivered to the cutter blade assembly in its forward direction, and in alignment with its cutting direction, so the cutter blade 94 advances with a chisel-like action.

As depicted in FIG. 7, a conveyor 97 in the middle of the front of assembly 10 above blade base 95 carries material broken up by cutter blade 94 away from the assembly, as for example in a window or pile between wheels or to a dump truck moving with the assembly. For the sake of clarity, the driving and supporting means for conveyor 97 are not shown. Diverters 99, 99', which extend across the front of assembly 10 above blade base 95 on either side of conveyor 97, are attached to brackets 100, 100'. Diverters 99, 99' are positioned to direct all the broken up material to conveyor 97. When frame 44 is lifted from its operating position for the purpose of transporting assembly 10 to a new location, by rams 52, 52', or by other lifting means, blade base 95 pivots against diverters 99, 99', or other stop means, so cutter blade 94 is raised and thus does not scrape along the ground during transportation.

Cutter blade 94 comprises a work tool that moves along the road surface, which comprises the work path. Cutting assembly frame 44 functions as a tool holder or carrier. Continuous unidirectional force is applied thereto by mobile carrier 11 in a direction parallel to the work path. Oscillators 56, 56' generate a reciprocating force, at least one component of which acts parallel to the work path. Each resonant beam 54, 54' comprises a force transmitting member, its upper extremity comprising an input to which the reciprocating oscillator force is applied, and its lower extremity comprising an output from which the reciprocating force is transferred to the tool. The tool advances intermittently along the work path responsive to the continuous unidirectional force applied by mobile carrier 11 and the reciprocating force applied by oscillators 56 and 56'.

Obviously, when the cutter blade 94 engages the material, reactive forces will be directed thereagainst, both in horizontal and vertical directions, and will be dependent upon the character of the material. An angle between 45° and 55° relative to the surface of the material has been found optimum for cutting pavement to maintain the ultimate cutting in a plane parallel to the material surface in the direction of machine travel. In general, the harder the material the larger the angle. Thus, for ordinary asphalt the angle has been found to be between 48° and 52°, for soft asphalt the angle has been found to be between 45° and 48°, and for concrete the angle has been found to be between 52° and 55°. The parallelogram units 36, 36' can be shifted by appropriate energization of the angular adjustment ram 50 to optimize the cutting action on the material encountered. Similarly, the cutting depth of cutter blade 94, below the grade, i.e., surface of the pavement, can be automatically or manually controlled by appropriate energization of the vertical adjustment rams 52, 52'. The previously described design of cutting assembly frame 44, which locates its center of gravity close to upright support beams 46, 46', i.e., nearly directly over cutter blade 94, permits the weight of cutting assembly frame 44 to counteract most effectively the reactive forces exerted on cutter blade 94 by the material being cut. This minimizes the forces and moments exerted on parallelogram units 36, 36' by cutting assembly frame 44 and discourages cutter blade 94 from moving out of engagement with the material being cut.

When the beams 54, 54' withdraw from contact with the cutter blade 94 during resonant vibration a momentary gap is formed which will remain until a repeated forward motion of the beams 54, 54'. To maximize the cutting force, it has been found that contact of the beams with the cutter blade preferably is made in the region where maximum forward velocity (and momentum) of the beams is approached in the forward (cutting) direction. Since the cutter blade 94 is in engagement with material to be cut, the adjacent beam is urged forwardly relative thereto, thus to close the momentary gap at the appropriate time of the resonant cycle.

Figure 5C:
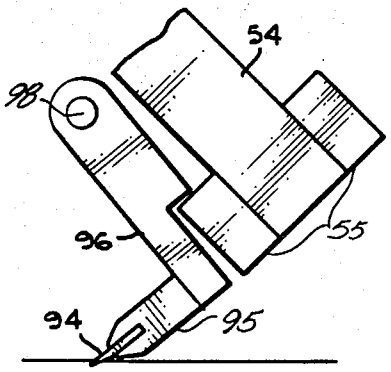
FIGS. 5A–5C are diagrammatic views of the tool and its drive mechanism in different stages of operation.
Figure 5B:
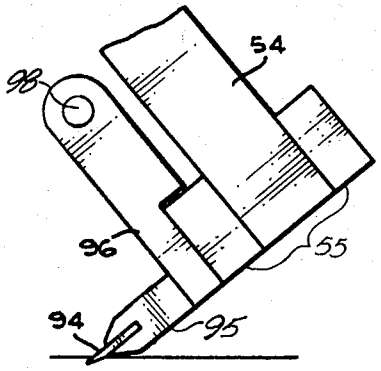
Figure 5A:
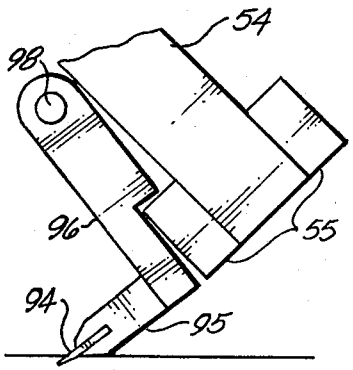

This action, which is important to the effective cutting of concrete, asphalt, and other hard materials, can be explained more readily by reference to FIGS. 5A–5C wherein the various operational dispositions of the cutter blade 94 and the resonant beams 54, 54' are diagrammatically illustrated in somewhat exaggerated form for purposes of explanation.

Figure 6:
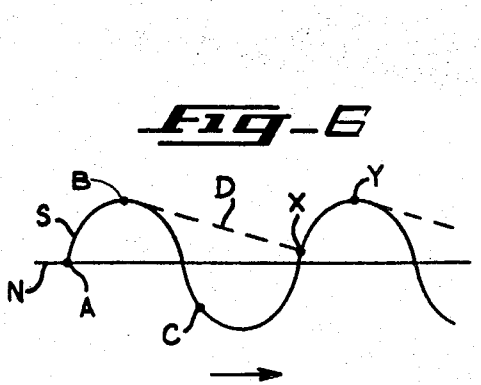
FIG. 6 is a graph showing the relationship of time and displacement of the tool and drive mechanism in the various operational stages shown in FIGS. 5A–5C.

In the time-displacement graph of FIG. 6, the abscissa N represents the neutral position of beams 54, 54', sinusoidal waveform S represents the reciprocating displacement of the beam outputs about their neutral position as a function of time, and the dashed line represents the position of the tool, i.e., cutter blade 94, relative to frame 44 as a function of time. For maximum force transfer, it is desirable for the beams to strike the tool when the beam outputs are traveling at maximum forward velocity, i.e., at the neutral position of the beam outputs. The neutral position of the beam outputs is their positions when at rest, i.e., not resonating or being deflected, while the beam is in operating position, i.e., pivoted into abutment with stop member 90. During operation, as beams 54, 54' resonate, when the beam outputs are at their neutral position, which is represented by point A in FIG. 6, a small momentary gap typically exists between beams 54, 54', and the back surface of lever arms 96, 96', as illustrated in FIG. 5A. As the beam outputs move slightly forward from their neutral position toward the tool, they simultaneously strike the tool and drive it forward to perform the desired work, i.e., cutting through the concrete or asphalt road surface. The beam outputs remain in contact with the tool, as illustrated in FIG. 5B, until the beam outputs reach the forward extremity, i.e., peak, of their reciprocating excursion, which is represented by point B in FIG. 6. This is approximately slightly less than 90° of the beam reciprocation cycle. As the beam outputs begin to move in a rearward direction on their reciprocating excursion, a momentary gap is formed between the beam outputs and the tool, which is represented by the distance between lines D and S in FIG. 6. The continuous forward movement of frame 44 with mobile carrier 11, while the tool is held stationary by engagement with the road surface, reduces the distance between the tool and the neutral position of the beam outputs, which is represented in FIG. 6 by the slope of line D toward line N. When the beam outputs are moving in a rearward direction, beams 54, 54' are spaced from lever arms 96, 96' as illustrated in FIG. 5C. The momentary gap between the tool and the beam outputs is maximum at a point of their reciprocating excursion slightly before the rear extremity, which is represented by point C in FIG. 6. In summary, during each cycle of reciprocation of beams 54, 54', the beam outputs contact the tool during a short interval approaching 90° of the beam cycle, which is represented in FIG. 6 by the distance along waveform S between points X and Y. During the remainder of each cycle, the beam outputs are out of contact with the tool, which is represented in FIG. 6 by the distance along line D between points B and X. As previously indicated, the most efficient transfer of force from the beam outputs to the tool occurs with a contact interval approaching 90° of the beam cycle. To achieve this contact interval, the speed of mobile carrier 11 is adjusted accordingly to the stroke of the beam outputs, i.e., their peak to peak amplitude. The larger the stroke, the faster the speed of mobile carrier 11.

Cessation of resonance is prevented when the tool encounters an immovable object or unyielding material during the forward movement of mobile carrier 11. Specifically, a protective gap is established between the neutral position of the beam outputs and the tool when the tool is unable to advance along the work path responsive to the impulses transferred to it by beams 54, 54'. (This is to be distinguished from the momentary gap described above, which continuously opens and closes during normal operation through yielding material.) In the embodiment disclosed in this specification, the peak sonic force generated by oscillators 56, 56' is substantially greater than the maximum tractive force generated by mobile carrier 11, i.e., the weight of the vehicle and its load. Specifically, the sonic force is sufficiently large relative to the tractive force to enable the sonic force to overcome the tractive force and to drive the entire machine, including material cutting assembly 10 and mobile carrier 11, backwards away from the tool when the tool is unable to advance along the work path. In my application Ser. No. 973,187, filed on even date herewith, the disclosure of which is incorporated herein fully by reference, the protective gap is established in a different manner, namely, by a tool stop which prevents the beam output in its neutral position from contacting the tool when it encounters an immovable object. In either way, by thus establishing a protective gap between the beam output in its neutral position and the tool when it encounters an immovable object, cessation of resonance is prevented. It has been discovered that without such a protective gap, when the tool encountered an immovable object the beam output becomes clamped between the tool and the tool holder, thus terminating resonance and preventing transfer of the oscillator force to the tool. This is a common source of damage to the parts of the tool driving apparatus such as the resonant beam, the oscillator, or portions of the tool carrier. Thus, the gap protects the tool driving apparatus from destruction by an immovable object. The term "immovable object" as used in this specification is relative, not absolute; it is an object that hinders the advance of the machine sufficiently that, in the absence of the protective gap, the vehicle would drive the force transmitting member against the tool and would thus prevent the force transmitting member from transmitting the oscillations to the tool, with the result that the apparatus would destroy itself. In the case of a resonant force transmitting member or beam as described herein, when the output of the beams is clamped against the tool, the end of the beam is no longer free and becomes a node. The nodes thus shift and the entire mode of vibration changes, the largest vibrations now occurring at the node supports, which destroys the node supports and/or the oscillator and beams.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. For example, the invention can be practiced with other types of force transmitting members, including resonant beams of other configurations, such as the angular configuration shown in my application, Ser. No. 973,187, filed on even date herewith, or non-resonant members. Further, the described support frame could be used with other types of apparatus, such as, for example, an earth or rock ripper.

What is claimed is:

1. A pavement planer comprising:

a transversely elongated cutter blade disposed at an acute angle between 45° and 55° to the surface of a pavement, the cutter blade extending in a downward and foward direction along a cutting plane to a cutting edge that lies in the cutting plane;

a support frame;

means for mounting the cutter blade on the support frame to permit reciprocation approximately in the cutting plane;

means mounted on the support frame for intermittently applying a unidirectional force at sonic frequency to the cutter blade parallel to the cutting plane in the forward direction; and means for continuously transporting the frame in the forward direction while applying the unidirectional force to advance the cutter blade incrementally in the forward direction when the cutter blade engages a pavement.

2. The pavement planer of claim 1, in which the support frame comprises plural spaced apart upright first support beams each having a top and a bottom, plural spaced apart forwardly projecting second support beams each having a front and a back, the second support beams being equal in number to the first support beams, the back of the second support beams being attached to the top of the respective first support beams to form plural first junctions, plural struts equal in number to the first support beams, the struts having a first end attached to the front of the respective second support beams to form plural second junctions and a second end attached to the bottom of the respective first support beams to form plural third junctions; the unidirectional force applying means comprises plural force transmitting beams equal in number to the first support beams, the force transmitting beams being mounted on the support frame so they are approximately parallel to the respective struts with an input near the front of the second support beam and an output near the bottom of the first support beam, and a source of vibrations connected to the input of the force transmitting beams to drive the output of the force transmitting beams into vibration about a neutral position, the output of the force transmitting beams lying behind the cutter blade approximately in the cutting plane; and the cutter blade lies approximately under the plural first support beams.

3. The pavement planer of claim 2, in which the first support beams have a larger mass per unit length than the second support beams and the struts.

4. The pavement planer of claim 3, in which the first support beams are two in number and the support frame additionally comprises a first cross beam connected between the first junctions, a second cross beam connected between the second junctions, and a third cross beam connected between the third junctions, the first and third cross b beams having a larger mass per unit length than the second cross beam.

5. The pavement planer of claim 4, in which the source produces oscillations at or near the resonant frequency of the force transmitting beams to produce therein an upper node and a lower node.

6. The pavement planer of claim 1, in which the mounting means includes means for adjusting the acute angle of the cutter blade.

7. The pavement planer of claim 1, in which the mounting means includes means for adjusting the elevation of the cutter blade.

8. The pavement planer of claim 1, in which the mounting means comprises means for pivotably mounting the cutter blade to rotate about a support axis parallel to the cutting plane and the cutting edge, such that the cutting edge lies in front of the support axis.

9. The pavement planer of claim 1, in which the transporting means applies to the frame a tractive force having a maximum value, and the unidirectional force applying means applied to the cutter blade a unidirectional force that is sufficiently larger than the maximum value of the tractive force to drive the frame back, thereby establishing a gap between the neutral position of the output of each force transmitting beam and the cutter blade.

10. The pavement planer of claim 1, in which the transporting means comprises a wheeled, motorized vehicle that applies a force up to a maximum value to the frame, the unidirectional force applying means applying to the cutter blade a force larger than the combined weight of the vehicle and its load.

11. The pavement planer of claim 1, in which the entire unidirectional force is parallel to the cutting plane.

12. The pavement planer of claim 1, in which the unidirectional force applying means comprises at least one elongated force transmitting beam unattached to the cutter blade and having an input and an output vibratory transverse to the beam length at a resonant frequency, the force transmitting beam being mounted on the support frame with its output behind the cutter blade in alignment with the cutting plane, and a source of vibrations at or near the resonant frequency connected to the input of the force transmitting beam.

13. The pavement planer of claim 1, in which the unidirectional force applying means comprises: plural, elongated, force transmitting beams, each having a longitudinal axis, an upper resonant node, a lower resonant node, an input at one end, and an output at the other end, the beams being mounted on the support frame so their longitudinal axis is transverse to the cutting plane and their output lies behind the cutter blade approximately in the cutting plane; and a source of vibrations connected to the input of the beams to drive the output thereof into vibration about a neutral position.

14. The pavement planer of claim 13, in which the unidirectional force applying means additionally comprising means for pivotably mounting the force transmitting beams at the upper node on the support frame, and plural stops attached to the support frame behind the respective force transmitting beams at the lower node.

15. The pavement planer of claim 14, in which the distance between the cutter blade and the neutral position of the output of each of the plural force transmitting beams is precisely the same so the plural force transmitting beams apply unidirectional force to the cutter blade in synchronism.

16. The pavement planer of claim 14, in which the stops are shimmed so the distance between the cutter blade and the neutral position of the output of each of the plural force transmitting beams is precisely the same so the plural force transmitting beams apply unidirectional force to the cutter blade in synchronism.

17. The pavement planer of claim 14, in which the means for pivotally mounting the force transmitting beams includes means for accommodating changes in the position of the upper node.

18. The pavement planer of claim 17, in which the accommodating means for each force transmitting beam comprises bearing means attached to the beam, closed annular elastic bearing support housing means surrounding the bearing means, a fluid in the housing means, and means for attaching the housing means to the support frame.

19. The pavement planer of claim 13, in which the source of vibrations has a frequency at or near the resonant frequency of the beams to drive the beams into resonant vibration.

20. The pavement planer of claim 19, additionally comprising means for preventing cessation of resonance when the cutter blade encounters an immovable object while the frame is being transported.

21. A method of removing pavement on a road bed comprising the steps of:

holding in contact with the pavement a transversely elongated cutter blade that extends in a downward and forward direction along a cutting plane to a transversely elongated cutting edge such that the cutting plane forms an acute angle with the surface of the pavement of between 45° and 55°;

engaging the pavement with the cutter blade such that the cutting edge penetrates the pavement; and intermittently driving the cutter blade at sonic frequency with a force parallel to the cutting plane in the forward direction while the cutting edge penetrates the pavement to drive the cutter blade incrementally in the forward direction and in a chisel like manner plane off the pavement.

22. The method of claim 21, in which the pavement is concrete and the acute angle is between 52° and 55°.

23. The method of claim 21, in which the pavement is soft asphalt, and the acute angle is between 45° and 48°.

24. The method of claim 21, in which pavement is ordinary asphalt, and the acute angle is between 48° and 52°.

25. The method of claim 21, in which the holding step comprises pivotally supporting the cutter blade for reciprocation approximately in the cutting plane.

26. The method of claim 25, in which the driving step comprises supporting an elongated force transmitting beam having a longitudinal axis transverse to the cutting plane, so that one end of the beam lies behind the cutter blade, applying to the other end of the beam an oscillating force at or near the resonant frequency of the beam to cause the one end of the beam to strike the cutter blade, and applying to the beam as a whole a unidirectional force to continuously move the beam in the forward direction.

27. The method of claim 26, in which the other end of the beam comprises an output that oscillates about a neutral position and the oscillating force is sufficiently larger than the maximum value of the unidirectional force to overcome the unidirectional force and to drive the tool holder back, thereby establishing a gap between the neutral position of the output and the cutter blade when the cutter blade is unable to advance responsive to the unidirectional force and the oscillating force.

28. The method of claim 25, in which the driving step comprises supporting a pair of substantially identical elongated force transmitting beams having longitudinal axes transverse to the cutting plane in spaced-apart relationship so that one end of each beam lies behind the cutter blade, coupling a sonic generator to the other end of each beam, the sonic generator producing vibrations at or near the resonant frequency of the beam, and continuously moving the beam in the forward direction.

29. The method of claim 28, in which the one end of each beam vibrates about a neutral position, and the gap between the neutral position of each beam and the cutter blade is precisely the same, so that the beams strike the cutter blade in synchronism.

30. Apparatus for performing work on a medium, the apparatus having a support frame; means for continuously transporting the support frame in a forward direction; an elongated force transmitting member mounted on the support frame at an acute angle so the top of the member lies forward of the bottom of the member; a vibration generator connected to the top of the member to cause vibrations at the bottom of the member; and a tool facing in the forward direction coupled to the bottom of the member, wherein the improvement comprises:

a support frame having an upright support beam with a top and a bottom;

a forwardly-projecting support beam having a front and a back, the back of the forwardly-projecting support beam being attached to the top of the upright support beam to form a junction; and a strut having a first end attached to the front of the forwardly-projecting support beam and a second end attached to the bottom of the upright support beam such that the strut is approximately parallel to the force transmitting member, the upright support beam having a larger mass per unit length than the forwardly projecting support beam and the strut, the bottom of the support beam and the tool lying near the upright support beam.

* * * * *